United States Patent [19]

Takami

[11] Patent Number: 4,850,180

[45] Date of Patent: Jul. 25, 1989

[54] PACKAGE STRAPPING MACHINE

[76] Inventor: Masaho Takami, 9-50, Kohrienyamanote-cho, Hirakata-shi, Osaka-fu, Japan

[21] Appl. No.: 176,173

[22] Filed: Mar. 31, 1988

[30] Foreign Application Priority Data

| | | | |
|---|---|---|---|
| May 27, 1987 | [JP] | Japan | 62-82015[U] |
| May 27, 1987 | [JP] | Japan | 62-82016[U] |
| Oct. 14, 1987 | [JP] | Japan | 62-157224[U] |
| Nov. 24, 1987 | [JP] | Japan | 62-179534[U] |

[51] Int. Cl.[4] ..... B65B 13/18; B65B 13/06

[52] U.S. Cl. ..... 53/589; 100/26; 100/33 PB

[58] Field of Search ..... 53/582, 589; 100/26, 100/33 PB

[56] References Cited

U.S. PATENT DOCUMENTS

| | | | |
|---|---|---|---|
| 2,597,675 | 5/1952 | Sackett | 100/26 |
| 2,738,747 | 3/1956 | Derrick | 53/589 X |
| 2,853,938 | 9/1958 | Hall | 100/26 |
| 3,183,824 | 5/1965 | Cook | 100/26 |
| 3,914,153 | 10/1975 | Sato | 53/589 X |
| 4,117,650 | 10/1978 | Ito | 53/589 X |
| 4,531,344 | 7/1985 | Sato | 53/589 X |
| 4,575,994 | 3/1986 | Takami | 53/589 X |

*Primary Examiner*—John Sipos

*Attorney, Agent, or Firm*—Wenderoth, Lind & Ponack

[57] ABSTRACT

The present invention relates to a package strapping machine suitable for tying a package or bundle into a circular shape. A concave base supports the package in the circular shape. A synthetic resin tape is looped around the package and the base, and a leading end of the tape is held against a lower surface of the base by a clamping mechanism. The tape is then tightened, and the leading end of the tape is clamped together with a trailing end of the tape. These tape portions are then heated and pressed to weld them together, and thus the package is tied in a circular shape. The concave base is then pivoted out from between the package and the tape. As the base pivots, stoppers adjacent the base contact portions of the tape to hold the tape and package in place and allow the base to be removed.

9 Claims, 3 Drawing Sheets

PACKAGE STRAPPING MACHINE

BACKGROUND OF THE INVENTION

The present invention relates to a package strapping machine for tightening a thermoplastic synthetic resin tape looped around a package to bind the package, particularly to a package strapping machine suitable for tying a package into a circular shape.

Automatic package strapping machines using a thermoplastic tape have been widely used for packaging various kinds of articles, because of their efficiency and labor saving operation. A tape is drawn out from a reel, wound around a package, tightened, and then both ends of the tape are heated and pressed to weld them together. Thus the package is automatically and closely tied.

According to the conventional package strapping machine, as shown in FIG. 5, a first clamp 2, a press 3 and a second clamp 4 are disposed side by side, immediately below a base 1 placed on an upper cover 11 of a table, so that they may move up and down. A thermoplastic tape A is drawn out from a reel 5 onto the table from between the second clamp 4 and the base 1 through a tape delivery and tightening mechanism 6 and a feed hole 7 of the first clamp 2. A leading end of the tape A is wound around a package B on the base 1, and is then inserted below the base 1. The first clamp 2 moves up by means of a cam mechanism 8 driven by a motor M, clamping the leading end of the tape A between the first clamp 2 and the base 1. Subsequently, after tightening the tape A by means of the mechanism 6, the second clamp 4 is moved up to clamp the inserted end and a trailing end of the tape A between the second clamp 4 and the base 1. Then the press 3 is moved up to cut the tape A with a cutting mechanism disposed between the press 3 and the first clamp 2. A heater enters a space between the upper tape and the lower tape immediately above the press 3, and the press 3 is moved up to press opposite upper and lower faces of the tape A together with the heater therebetween. The opposite upper and lower faces of the tape A are continued to be pressed together by the press 3 after the heater is withdrawn to weld them together.

Immediately after the tape is welded, both clamps 2, 4 and the press 3 are lowered, and the base 1 is drawn out from the space between the tape and the package B to finish the packaging process. At this point the tape delivery and tightening mechanism 6 is again operated to deliver another length of the tape A above the base 1. The machine is then prepared for the next packaging process.

However, the base 1 in the conventional package strapping machine, as shown in FIG. 5, has a flat upper surface. When a package is to be tied into a circular shape, as in bundles of articles such as flowers and wires, the use of a flat base has poor results. Not only is the operation difficult to carry out, but the overall length of the tape extending over the base 1 and the package B is much longer than necessary. This leaves little tension in the tape after the packaging process is completed. As a result, a strong tightly-bound packaged condition cannot be obtained.

In addition, when the package is removed from the base 1 after the completion of the welding of the tape, the base must be withdrawn through the space between the package and the tape.

If the tightening force of the tape wound around the package and the base is increased in order to create a more tightly bound package, a disadvantage occurs. The tape will tightly hold the package to the base, and be moved together with the base when the base is withdrawn, thus preventing removal of the base.

OBJECTS OF THE INVENTION

It is a first object of the present invention to provide a package strapping machine having a superior shape-holding property and capable to satisfactorily tying packages into a circular shape.

It is a second object of the present invention to provide a package strapping machine capable of obtaining a strongly strapped condition in which no slackness exists in the strap.

It is a third object of the present invention to provide a package strapping machine capable of securely withdrawing a base from between the strap and the package.

DETAILED DESCRIPTION OF THE INVENTION

Figure 3:
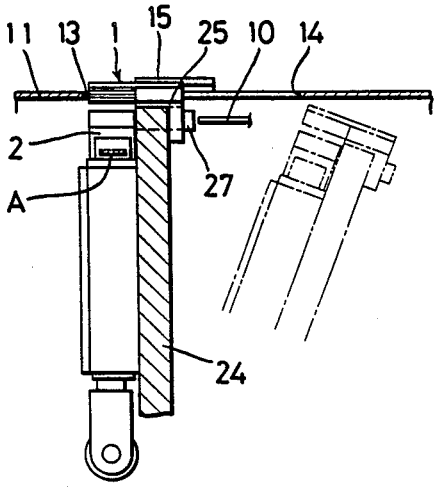
FIG. 3 is an elevational sectional side view showing a base-installing portion in FIG. 1.
Figure 4:
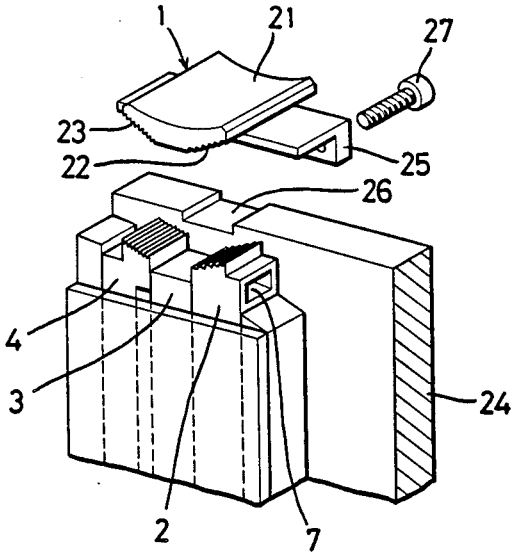
FIG. 4 is an exploded perspective view showing the base-installing portion in FIG. 1.
Figure 5:
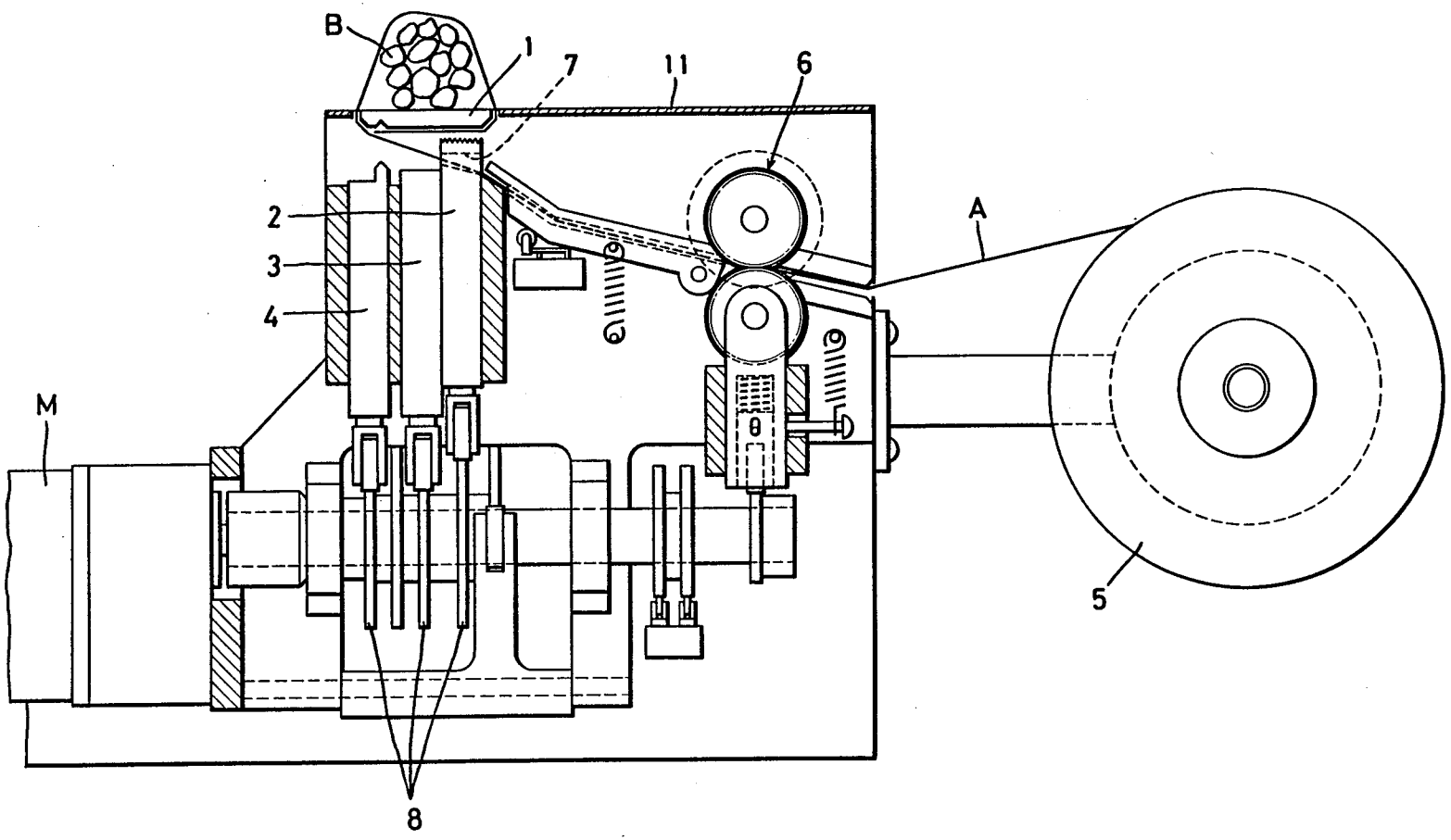
FIG.5 PRIOR ART
FIG. 5 is an elevational front view showing principal parts of the conventional package strapping machine.

In FIGS. 1 to 4, showing the package strapping machine according to the present invention, the parts similar to those in FIG. 5 showing the conventional package strapping machine are marked with the same reference numerals as in FIG. 5. Accordingly, their description is omitted.

Figure 1:
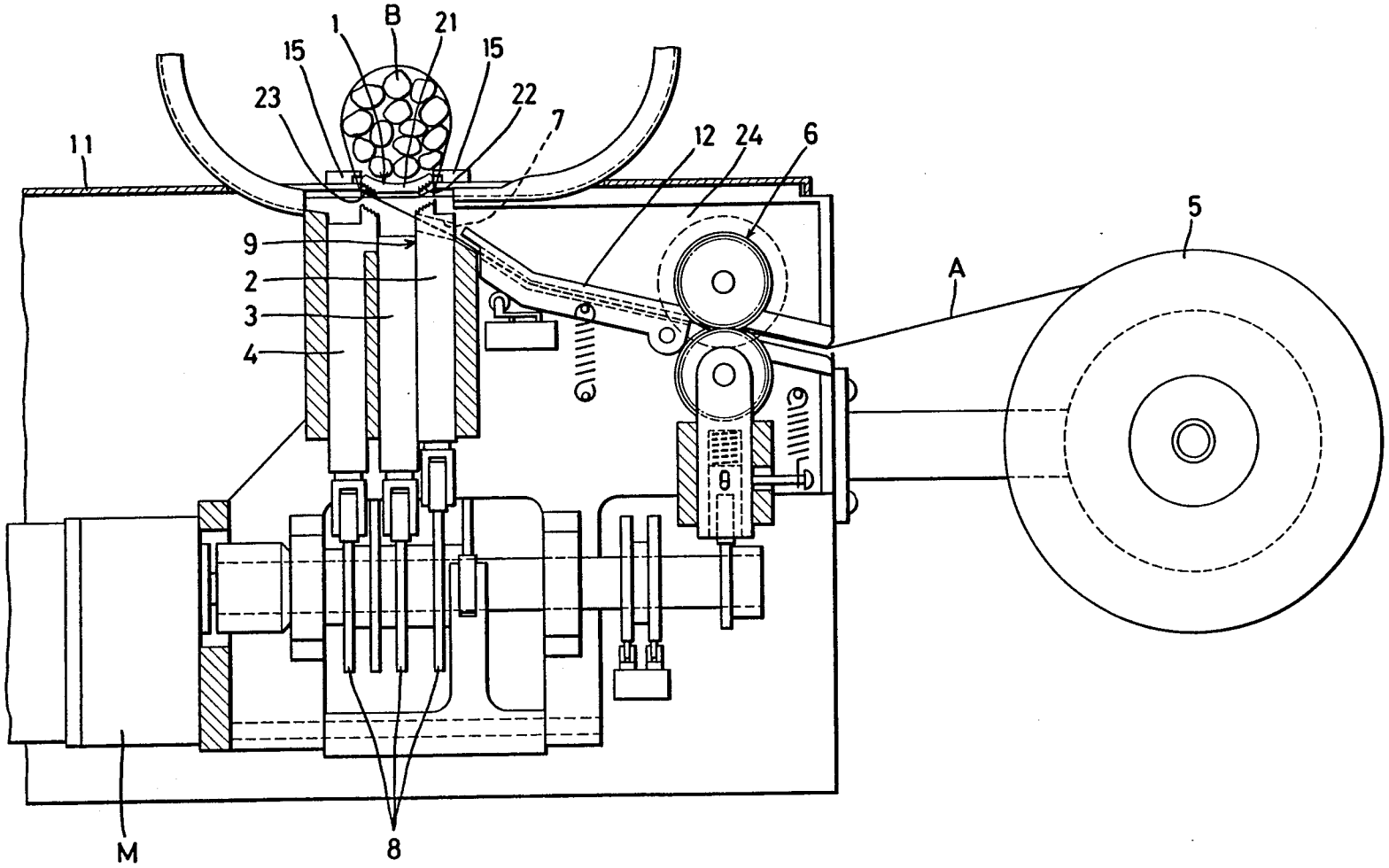
FIG. 1 is an elevational front view showing principal parts of a package strapping machine according to the present invention.

As shown in FIGS. 1 and 4, a base 1 has an upper concave surface 21. The sides of a lower surface of the base 1 form inclined surfaces 22, 23, inclined in opposite directions at positions opposite an upper end of a first clamp 2 and an upper end of a second clamp 4.

Although the concave surface 21 is shown as a curved shape in the drawings, it may alternatively be a polygonal concave surface. A lower surface of the base 1 is flat at its center, facing an upper surface of a press 3. The inclined surfaces 22, 23 are positioned on both sides of the base 1, and upper end surfaces of the first clamp 2 and the second clamp 4 form inclined surfaces corresponding to the inclined surfaces 22, 23.

The width of the base 1 is selected to be as narrow as possible, but still within the range required for welding a tape, so that no loss in length may occur when the tape is wound around a package.

In the present construction of the package strapping machine, the principal constituent members are mounted on a swing plate 24. The base 1 is drawn out from a space between the tape A and the package B by the swing plate 24 being pivoted by a cam mechanism 8. A construction may be adopted, however, wherein the constituent members are mounted on a fixed plate, and only the base supported on a swing plate.

An upper cover 11 of the table is provided with a long tape passage groove 13. Tape A is fed from a tape guide 12 through the upper cover 11 from below the base 1 via groove 13. A leading end of the tape A is directed back through the groove 13 to a position underneath the base 1.

Figure 2:
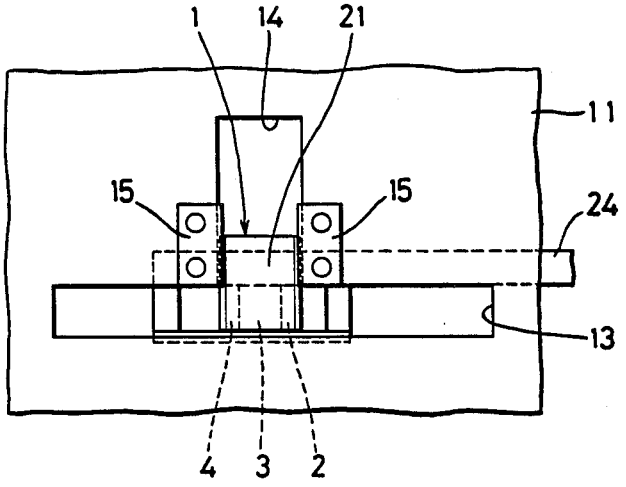
FIG. 2 is a plan view showing the principal parts in FIG. 1.

In addition, the upper cover 11, as shown in FIG. 2, is provided with a vacant portion or opening 14. The portion 14 corresponds to an area and moving range of the base 1 in the direction in which the base 1 is withdrawn.

As shown in the drawings, the base 1 projects slightly above the upper surface of the upper cover 11 when the base 1 is in its advanced position. The vacant portion 14 may be almost as narrow as the base 1, and should be long enough to allow the withdrawal of the base.

Stoppers 15 are adjacent the long groove 13, provided on both sides of the vacant portion 14. Ends or flanges of both stoppers 15 are projected behind two portions of the tape A strapped around the package B, as best seen in FIG. 1. The tape A thus engages the stoppers 15 when the base 1 is withdrawn, preventing the package B from moving together with the base. The base 1 can then be smoothly drawn out from between the package B and the tape A.

FIGS. 3 and 4 show the installation of base 1 on the swing plate 24, the base 1 being advanced and retreated by the pivoting of the swing plate 24. The base 1 is provided on an upper surface of an L-shaped bracket 25. A space 26 receives the heater 10 when it is advanced, and is formed in an upper surface of the swing plate 24. The L-shaped bracket 25 is placed on the swing plate 24 and detachably fixed by a fastener 27.

A package strapping machine according to the present invention has the above-described construction. The package strapping operation is described below.

A package B, e.g. a bundle of flowers or wires, is placed on the concave base 1. The circular shape is maintained by the concave surface 21. A tape A fed forward by mechanism 6 passes through the tape guide 12 and feed hole 7, under base 1, and out onto the table 11 via the groove 13. The tape is directed around the package B by an arch (partially shown in FIG. 1, but not labelled) and feeds back trhough groove 13 underneath the base 1. The leading end is then held fast against base 1 by clamp 2. The delivery and tightening mechanism 6 then tightens the tape A about the package B. The second clamp 4 moves up to clamp both the leading and trailing ends of the tape A against the base. The heater 10 is then inserted between the overlapped portions of the tape A, and the pressing device 3 presses the tape portions and the heater together against the base 1. The heater is subsequently withdrawn, and the pressing device presses the tape portions to weld them together. When welding is complete, the clamps 2 and 4 and the pressing device 3 are lowered. Swing plate 24 then pivots to withdraw the base 1 from between the package B and the tape A. The base 1 pivots down through the vacant portion 14 to a position below the upper cover 11. The package B is prevented from moving with the base 1, even though the tape A is tight around the package B, because the stoppers 15 engage edges of the tape A.

From the above description, it can be seen that a bundle of articles can be successfully tied into a circular shape. The concave shape of the base 1 holds the bundle in the circular shape. The small size of base 1, combined with the inclined surfaces 22, 23, reduces the amount of tape necessary to tie the package. The stoppers 15 prevent the tied package from moving with the base 1, and thus allows the tape A to be tight about the package. These conditions allow the circular shape of the package to be maintained.

What is claimed is:

1. A package strapping machine for tying a package in a circular shape, comprising:
   - a base for supporting said package, said base having a concave upper surface for receiving and holding said package in said circular shape;
   - a table having an upper cover, said upper cover having an opening for receiving said base;
   - means for moving said base through said opening between a strapping position wherein said base projects above said upper cover and a withdrawn position wherein said base is disposed below said upper cover;
   - means for delivering and tightening a tape about said package and said base when said base is in said strapping position, said base thus being disposed between a portion of said tape and said package; and
   - means for fastening a leading end and a trailing end of said tape together to thereby tie said package,
   - whereby said base can receive said package in said strapping position, and can be moved to said withdrawn position to remove said base from between said package and said portion of said tape.

2. The package strapping machine of claim 1, wherein said base has a lower surface comprised of a flat middle section and two side sections, said side sections being disposed on opposite sides of said middle section and being outwardly and upwardly inclined from said middle section.

3. The package strapping machine of claim 1, further comprising means disposed on said upper cover for preventing movement of said package upon movement of said base from said strapping position to said withdrawn position.

4. The package strapping machine of claim 3, wherein said means for preventing movement of said package comprises a pair of stoppers disposed adjacent said opening, said stoppers each having a flange arranged so as to engage a section of said tape tied about said package upon movement of said base from said strapping position to said withdrawn position.

5. The package strapping machine of claim 1, and further comprising an elongated groove in said upper cover adjacent said opening and perpendicular to a direction of movement of said base, arranged such that when said base is in said strapping position, portions of said groove extend to either side of said base, thereby allowing said tape to be delivered and tightened about said package and said base through said groove portions.

6. The package strapping machine of claim 1, wherein said means for moving said base comprises a member supporting said base and mounted to pivot said base between said strapping position and said withdrawn position.

7. The package strapping machine of claim 6, and further comprising:
   - an L-shaped bracket detachably mounting said base to the top of said member; and
   - a space formed on said top of said member adjacent a flat middle section of a lower surface of said base.

8. The package strapping machine of claim 7, wherein said means for fastening includes a heater movable through said space on said top of said member to a welding position adjacent said flat middle section of said lower surface of said base, and a pressing device movably mounted on said member for pressing said leading and trailing ends together with said heater against said flat middle section, to thereby fasten said leading and trailing ends together by welding.

9. The package strapping machine of claim 8, further comprising:

said lower surface of said base further including two side sections disposed on opposite sides of said middle section, said side sections being outwardly and upwardly inclined from said middle section;

a first clamp movably mounted on said member on one side of said pressing device for clamping said leading end of said tape against one said side section; and a second clamp movably mounted on the opposite side of said pressing device for clamping said leading and said trailing ends together against the other said side section.

* * * * *